US009184488B2

(12) United States Patent
Portier et al.

(10) Patent No.: US 9,184,488 B2
(45) Date of Patent: Nov. 10, 2015

(54) ANTENNA ASSEMBLY DEVICE

(75) Inventors: Olivier Portier, Lannion (FR); Gérard Jacob, Lannion (FR); Jean-Pierre Harel, Lannion (FR)

(73) Assignee: Alcatel Lucent, Boulogne-Billancourt (FR)

( * ) Notice: Subject to any disclaimer, the term of this patent is extended or adjusted under 35 U.S.C. 154(b) by 568 days.

(21) Appl. No.: 13/254,519

(22) PCT Filed: Feb. 19, 2010
(Under 37 CFR 1.47)

(86) PCT No.: PCT/FR2010/050287

§ 371 (c)(1),
(2), (4) Date: Dec. 9, 2011

(87) PCT Pub. No.: WO2010/100361

PCT Pub. Date: Sep. 10, 2010

(65) Prior Publication Data

US 2012/0127054 A1 May 24, 2012

(30) Foreign Application Priority Data

Mar. 6, 2009 (FR) ..... 09 51417

(51) Int. Cl.
*H01Q 1/12* (2006.01)
*H01Q 1/20* (2006.01)

(52) U.S. Cl.
CPC ..... *H01Q 1/1207* (2013.01); *H01Q 1/20* (2013.01); *Y10T 29/5313* (2015.01)

(58) Field of Classification Search
CPC ..... H01Q 1/12; H01Q 1/125; H01Q 1/1221; H01Q 1/1207; H01Q 1/20; H01Q 1/246; H01Q 21/26; H01Q 21/28; H01Q 21/24; H01Q 19/10; H01Q 19/104; H01Q 19/108; H01Q 21/062; H01Q 25/001
USPC ..... 343/796, 797, 798, 799, 800, 878, 892
See application file for complete search history.

(56) References Cited

U.S. PATENT DOCUMENTS 6,040,802 A * 3/2000 Smith et al. ..... 343/700 MS
6,069,590 A * 5/2000 Thompson et al. ..... 343/795

(Continued)

FOREIGN PATENT DOCUMENTS

CN 1205118 A 1/1999
CN 2658957 Y 11/2004

(Continued)

OTHER PUBLICATIONS

International Search Report for PCT/FR2010/050287 dated Jun. 11, 2010.

(Continued)

*Primary Examiner* — Robert Karacsony
*Assistant Examiner* — Patrick Holecek
(74) *Attorney, Agent, or Firm* — Fay Sharpe LLP

(57) ABSTRACT

An object of the present invention is a device for assembling the components of a panel antenna that comprises at least one volumic radiating element comprising a base atop which is mounted a radiating plane, and at least one component of the antenna's mechanical structure. The device comprises a dielectric member comprising a central area comprising a first fastening means cooperating with the radiating component, lateral areas comprising second fastening means cooperating with longitudinal edges of the antenna's mechanical structure, and an intermediate area comprising a third means of flexible linking between the first and the second fastening means.

19 Claims, 5 Drawing Sheets

(56) References Cited

U.S. PATENT DOCUMENTS

Figure 1:
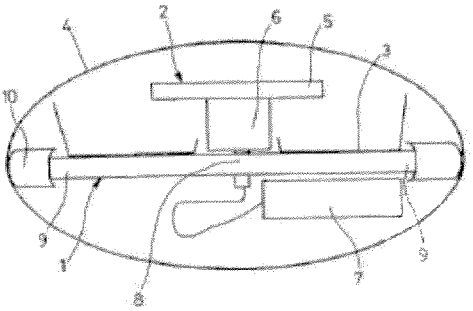

| | | | | |
|---|---|---|---|---|
| 6,275,181 | B1 | 8/2001 | Kitayoshi | |
| 6,933,906 | B2 * | 8/2005 | Stolle et al. | 343/797 |
| 2003/0107881 | A1 * | 6/2003 | Muramatsu et al. | 361/818 |
| 2004/0183734 | A1 | 9/2004 | Noro | |
| 2004/0201537 | A1 | 10/2004 | Stolle et al. | |
| 2006/0290591 | A1 * | 12/2006 | Nilsson et al. | 343/906 |
| 2010/0188310 | A1 | 7/2010 | Saddington et al. | |

FOREIGN PATENT DOCUMENTS

| | | | |
|---|---|---|---|
| CN | 2808764 | Y | 8/2006 |
| CN | 1893174 | A | 1/2007 |
| CN | 201146646 | Y | 11/2008 |
| DE | 10 2007 033817 | B3 | 12/2008 |
| EP | 0862239 | A1 | 9/1998 |
| JP | 2000307329 | A | 11/2000 |

OTHER PUBLICATIONS

English Bibliography for Chinese Patent Application Publication No. CN2658957Y, published Nov. 24, 2004, printed from Thomson Innovation on Sep. 20, 2014, 4 pp.

English Bibliography for Chinese Patent Application Publication No. CN1205118A, published Jan. 13, 1999, printed from Thomson Innovation on Sep. 20, 2014, 4 pp.

English Bibliography for Chinese Patent Application Publication No. CN1893174A, published Jan. 10, 2007, printed from Thomson Innovation on Sep. 20, 2014, 4 pp.

English Bibliography for Chinese Patent Application Publication No. CN2808764Y, published Aug. 23, 2006, printed from Thomson Innovation on Sep. 20, 2014, 3 pp.

English Bibliography for Chinese Patent Application Publication No. CN201146646Y, published Nov. 5, 2008, printed from Thomson Innovation on Sep. 20, 2014, 3 pp.

English Bibliography for German Patent No. DE102007033817B3, published Dec. 18, 2008, printed from Thomson Innovation on Sep. 20, 2014, 5 pp.

English Bibliography for Japanese Patent Application Publication No. JP2000307329A, published Nov. 2, 2000, printed from Thomson Innovation on Sep. 20, 2014, 4 pp.

PCT App. No. PCT/FR2010/050287, English Translation of PCT Written Opinion of the International Searching Authority, mailed Jun. 11, 2010, 5 pp.

* cited by examiner

ANTENNA ASSEMBLY DEVICE

The present invention pertains to the field of telecommunications antennas transmitting radio waves in the domain of hyper frequencies by means of volumic (three-dimensional) radiating elements, and more particularly but not exclusively, to an antenna assembly device.

Building an antenna comprises steps of mechanically fastening its components to one another. Currently, most antenna manufacturers use a mechanical assembly comprising a framework, serving as a central mechanical structure, onto which are fastened all the other components, such as radiating elements, power dividers, phase shifters, reflective surfaces, parasitic elements, etc. Once all of the elements have been assembled around the framework, the whole assembly is surrounded by a radome.

In order to withstand the mechanical forces, due to the weight of the components and the constraints imposed by the environment, this framework is manufactured from a material, most commonly a metallic one, with sufficient hardness and thickness. This initial constraint limits later mechanical choices. It requires that the compromises made in design, particularly between electrical and mechanical factors and the manufacturing cost, be mainly guided by the mechanical requirements, in order to guarantee the stability of the antenna's performance. For example, antenna about 2 m long that works within a frequency band around 2 GHz comprises an aluminum framework whose thickness is between 1.5 mm and 2.5 mm. However, if only the depth related to the skin effect in the frequency range is taken into account, the required thickness would be less than 0.1 mm.

The presence of metallic connections and their positioning between the components forces a choice of mechanical fastening solutions, such as screwing or welding. Otherwise, due to the inevitable degradation of the electrical contacts, the antenna could be confronted with intermodulation products (IMPs) that manifest as a distortion of the signals traveling through the antenna, such as performance losses if these degradations occur in areas where electromagnetic fields are intense. These assembly techniques have serious drawbacks. They lead to additional costs, in particular due to the time required to carry out the operation and also to the need for greater quality controls on the link that is created. Furthermore, these assembly techniques make disassembly dangerous, or even impossible.

Panel antennas normally comprise an array of volumic radiating elements fastened onto a longitudinal mechanical structure. The problem therefore is finding an assembly device that makes it possible to position and fasten radiating elements onto the structure, and potentially other components involved in the construction of a panel antenna, so as to obtain a link that is mechanically and electrically efficient and free of intermodulation products (IMPs).

The purpose of the invention is therefore to particularly propose a device for assembling the components of a panel antenna that makes it possible to fasten volumic radiating elements onto a component of the antenna's mechanical structure quickly, reliably, reversibly, and inexpensively.

The sought-after solution must particularly simultaneously take into account the following requirements:

- avoid the use of techniques such as screwing and/or welding to perform the mechanical assembly of the radiating elements and the reflector,
- use a non-conducting part as a mechanical vector of the assembly,
- create capacitive electrical connections, meaning with no direct metal-metal contact.

It is a further purpose of the present invention to propose an antenna comprising volumic radiating elements mechanically connected to a reflector whose thickness is less than in the prior art, without compromising the antenna's mechanical resistance.

It is a further purpose of the present invention to propose a method for fastening a radiating element coupled to a conducting reflector, which is faster yet also more reliable than prior methods.

The object of the present invention is a device for assembling the components of a panel antenna that comprises at least one volumic radiating element comprising a base upon which is mounted a radiating plane and at least one component of the antenna's mechanical structure, which device comprises a dielectric member comprising:

- a central area comprising a first fastening means cooperating with the radiating element,
- lateral areas comprising two fastening means cooperating with longitudinal edges of the antenna's mechanical structure,
- an intermediate area comprising a third means of flexible linking between the first and the second fastening means.

The dielectric member comprises the means needed to fasten the volumic radiating element, particularly including the holes, clamps, clips, or pins. Advantageously, the first fastening means cooperating with the radiating element is a snap-in-place fastening means. Thus the assembly is made quickly and easily, and disassembly is possible without deterioration.

According to a preferred embodiment of the invention, the first fastening means comprises at least one formation capable of fitting into the base of the volumic radiating element. The fastening of the mechanical element onto the dielectric member by snap-in-place means may be carried out by way of formations of several types: ring shapes, protruding shapes, U-shapes, twisting, etc.

The dielectric member must be capable of absorbing vibrations and shocks, in order to prevent transmitting them to the radiating element. For this reason, the dielectric member may further comprise at least one dampener.

It is an advantage of the invention that the reflector, serving as a mechanical structure, placed in the center of the antenna along its longitudinal axis, no longer directly absorbs outside mechanical stresses, as the radiating element is now connected to it by way of the dielectric member. The reflector, free of these stresses, only retains its function as a conductive electrical reflector.

All of the components involved in constructing a panel antenna, particularly the reflector, the radiating elements, the radome, the screens, the parasitic elements, etc. may be connected to the dielectric member that ensures the assembly's mechanical rigidity:

The dielectric member must be rigid enough to withstand the mechanical stresses that are forced on it, and must simultaneously ensure the flexibility of the mechanical link between the radiating element and the reflector. This member will advantageously be made of a polymer material, such as polyoxymethylene (POM), polypropylene (PP) or a copolymer of acrylonitrile/butadiene/styrene (ABS), potentially loaded with fiberglass. Preferentially, the dielectric member is molded from only one piece.

By researching its design and selecting the material of the dielectric member, the inventive assembly device makes it possible to more easily keep control over vibrations or external shocks. For example, the use of plastics makes it possible to at least partially absorb the forces exerted by the outside mechanical environment, and to limit their propagation through the components inside the antenna.

The invention also proposes a panel antenna comprising at least one volumic radiating element that comprises a base upon which is mounted a radiating plane, at least one component of the antenna's mechanical structure, and an assembly device as described previously. The dielectric member is disposed transversely in relation to the antenna's longitudinal axis. The electrical connection between the volumic radiating element and the flat conductive mount, serving particularly as reflector, placed facing the radiating plane, is capacitive.

According to a first embodiment, the component of the antenna's mechanical structure is the radome.

According to a second embodiment, the component of the antenna's mechanical structure is the reflector.

Reducing the mechanical stresses exerted on the components within the antenna increases the antenna's overall reliability. Its operational life span is also increased by reducing intermodulation products (IMPs). First, the invention makes it possible to greatly reduce these stresses on the antenna's reflector, to the extent that it is no longer in direct contact with the outside environment.

The invention also proposes a method for assembling the components of a panel antenna comprising at least one volumic radiating element comprising a base atop which is mounted a radiating plane to be fastened onto at least one component of the antenna's mechanical structure, and an assembly device as previously described, within which the dielectric member is disposed transversely in relation to the antenna's longitudinal axis.

Figure 2:
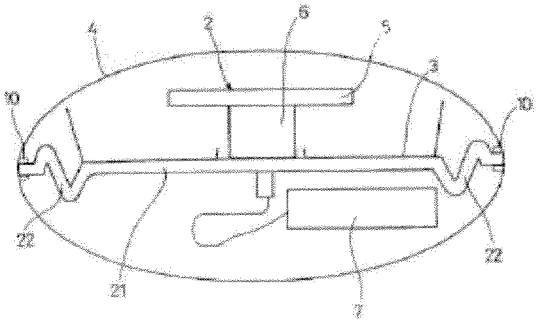
Figure 3:
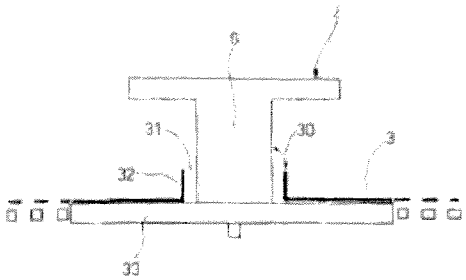
Figure 4:
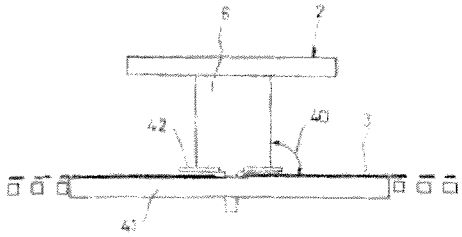
Figure 5:
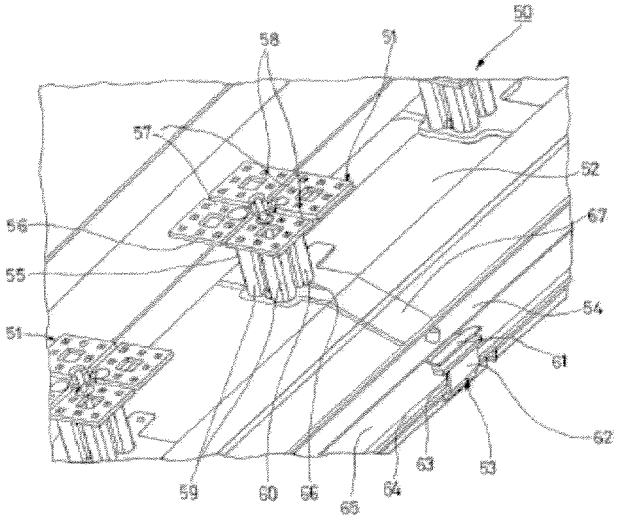
Figure 6:
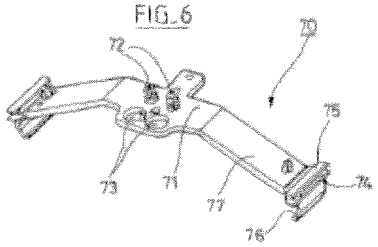
Figure 7:
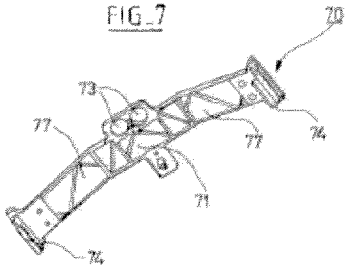
Figure 8:
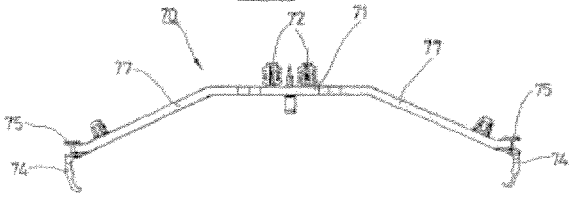
Figure 9:
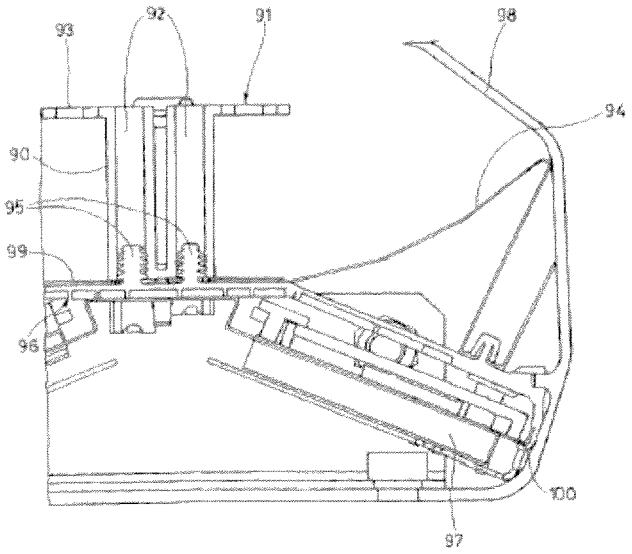

Other characteristics and advantages of the present invention will become apparent upon reading the following description of one embodiment, which is naturally given by way of a non-limiting example, and in the attached drawing, in which:

FIG. 1 schematically depicts the fastening of a volumic radiating element by way of an assembly device according to the invention, FIG. 2 schematically depicts the fastening of a volumic radiating element by way of a variant embodiment of an assembly device according to the invention, FIG. 3 shows a first mode of capacitively coupling a volumic radiating element with the reflector, FIG. 4 shows a second mode of capacitively coupling a volumic radiating element with the reflector, FIG. 5 depicts a partial perspective view of a panel antenna comprising a volumic radiating element fastened by way of an assembly device according to a preferred embodiment of the invention, FIG. 6 is a top-down perspective view of the dielectric member of an assembly device according to a preferred embodiment of the invention, FIG. 7 is a bottom-up perspective view of the assembly device in FIG. 6, FIG. 8 is a three-dimensional profile view of the assembly device in FIG. 6, FIG. 9 is a partial cross-section of antenna showing how the antenna's components cooperate with an assembly device according to the embodiment in FIG. 6, FIG. 1 schematically depicts the usage principle of an assembly device according to one embodiment of the invention, comprising a dielectric member 1 for fastening a volumic (i.e. three-dimensional) radiating element 2 capacitively coupled to a flat conductive mount, for example, the reflector 3 of an antenna. A radome 4 surrounds and protects the elements that make up the antenna. The radiating element 2 comprises a radiating plane 5, formed of dipoles, supported by a base 6 that is normally tube-shaped. The radiating element 2 is fed by way of accessories 7 such as a current splitter, a phase-shifter, etc. The dielectric member 1 comprises, in its central area 8 a fastening means the radiating element 2, and in its lateral areas 9, fastening means cooperating with longitudinal edges 10 that belong to a component of the antenna's mechanical structure, such as the reflector 3 or the radome 4.

FIG. 2 shows a variant embodiment of an assembly device that comprises a dielectric member 21 comprising dampeners 22 that make it possible to reduce the transmission onto the radiating element 2 of shocks and vibrations coming from the antenna's outside environment.

In order to avoid intermodulation products (IMPs) caused by direct metal-metal contact to as great an extent as possible, the electrical connections are created by capacitive coupling. Capacitive coupling may be carried out in different ways, as depicted in FIGS. 3 and 4.

In the example in FIG. 3, the capacitive coupling 30 of the radiating element 2 with the reflector 3 is obtained by combining, first, a space of air 31 forming an insulating layer between the base 6 of the radiating element 2 and the folded edge 32 of the reflector 3, and second, a dielectric member 33 belonging to the assembly device of the radiating element 2. Alternatively, a solid film of dielectric material may be placed inside the space 31.

FIG. 4 shows another examplary capacitive coupling 40 of the radiating element 2 with a flat reflector 41. In this situation, it is necessary to place a film 42 of insulating material between the base 6 of the radiating element 2 and the flat reflector 41.

FIG. 5 represents a perspective view of an antenna 50 comprising an assembly device according to a preferred embodiment of the invention. The radiating elements 51, the reflector 52, and the dielectric member 53 of the assembly device, disposed beneath a radome 54, are made visible by imposing a transparency.

The radiating element 51 is composed of a base 55 supporting a radiating plane 56 comprising two dipoles 57, 58 each a half-wavelength long, orthogonally joined to obtain a cross- and dual-polarization arrangement. Each dipole 57, 58 is respectively provided with a feed. The base 55 is made up of four tube portions; two tubular portions 59 are used to allow the feed of the dipoles through, and two tubular portions 60 are free.

Note that the dielectric member 53 of the assembly device placed beneath the reflector 52 comprises a dampener 61 and each end. The lateral areas 62 of the dielectric member 53 support fastening means 63 that hook on to each end of the reflector 52 on the longitudinal edges 64, belonging to a component 65 of the antenna's mechanical structure, here the lower part of the radome 54. The base 55 of the radiating element 51 is retained by the fasting means located within the central area 66 of the dielectric member 53. Intermediate areas 67 join the central area 66 to the lateral areas 62.

FIGS. 6, 7, and 8 will now be considered; they show the preferred embodiment of the assembly device's dielectric member 70 in greater detail.

The dielectric member 70 comprises a central area 71 comprising a fastening means including at least one formation 72 capable of fitting into one of the open tubular portions of the radiating element's base in order to keep it snapped in place. The central area 71 further comprises at least one hole 73 for allowing the dipoles' feed through.

The dielectric member 70 further comprises lateral areas 74 advantageously equipped with dampeners 75 to limit the transmission onto the radiating element of vibrations or shocks that may come from the outside environment. Each lateral area is equipped with a fastening means 76 onto a component of the antenna's mechanical structure. In the present situation, this fastening means 76 roughly has a hook shape, intended to hook onto the longitudinal edges.

The dielectric member 70 finally comprises intermediate areas 77 that connect the central area 71 to the lateral areas 74 respectively. The intermediate area 77 must ensure a flexible link in order to grant the dielectric member of that ability to absorb any variations, shocks or deformations that may occur.

Thanks to these different parts, it is possible to use the dielectric member 70 to assemble multiple components of the antenna, such as the reflector, the radiating elements, the radome, the screens, the parasitic elements, etc. the dielectric member 70 must be rigid enough to withstand the mechanical stresses caused by the components of the antenna that are attached to it, yet flexible enough to limit the transmission of vibrations and shocks. This absorption ability makes it possible to increase the lifespan of the components placed within the antenna, which receive less force. At the same time, performance with respect to intermodulation products (IMPs) is improved owing to the reduced transmission of outside stresses to the inside of the antenna. Preferentially, the dielectric member 70 is molded from a single piece out of a plastic material.

The cross-section in FIG. 9 shows in detail the fastening of a radiating element inside an antenna by way of an assembly device according to one particular embodiment of the invention. The base 90 of the radiating element 91 is made up here of four tube portions 92. The main function of the base 90 is to keep the radiating plane 93 away from the radiating element 91 of the reflector 94, and to allow the grounding of the radiating element 91. Two of these tube portions are used to allow through coaxial cables to feed the dipoles. The other two tube portions 92 are available for fastening the radiating element 91.

In the mode of embodiment depicted here, shaped pins 95 supported by the dielectric member 96 are pushed into the tube portions 92 by force. These pins 95 are preferentially corrugated, so as to increase friction in order to ensure the retention of the radiating element 91. The reflector 94 is disposed above the dielectric member 96 and comprises openings to allow through the passage of portions used to allow cables through. The dielectric member 96 simultaneously supports the radiating element 91, the reflector 94, the accessories 97 associated with the feeding of the radiating element, and the radome 98. Each lateral area is equipped with a fastening means on to a component of the antenna's mechanical structure, which in the present case is the lower part of the radome 98. Thanks for this assembly device, the fastening of the radiating element 91 and the antenna's other components 94, 97, 98 is very easy, simple, and effective. No tools or external parts are needed to assemble the components together.

A thin insulating film 99, such as a thin plastic piece or plastic film, for example, may, if necessary, be placed between the radiating element 91 and the reflector 94. Given the surface of the base 90 of the radiating element 91 with respect to the antenna's frequency domain, a thin isolating film disposed between the radiating element 91 and the reflector 94 is sufficient to create the conditions for capacitive coupling, meaning that the electromagnetic field between the radiating element 91 and the reflector 94 is high enough to couple the electromagnetic power from one to the other. This ability to create capacitive coupling is obtained with very inexpensive materials (thin plastic film). It also makes it possible to increase the antenna's IMP capacity. As electromagnetic fields are very high in this region, the link between the radiating element 91 and the reflector 94 is sensitive to intermodulation products (PIM), which is one possible cause of the formation of IMPs Insulating the radiating element 91 from the reflector 94 is one way to remedy this problem.

FIG. 9 portrays in detail the fastening of the accessories 97 associated with the feed array of the radiating elements 91, the reflector 94 and the radome 98 by way of the assembly device 96. It is observed that the thickness of the reflector 94 has been considerably decreased compared to the prior art, because this part no longer has to support the mass of the antenna's components (radiating element 91, feed and its accessories 97, screens or traps, parasitic elements, radome 98, etc. . . . ) and the corresponding mechanical forces. In the example embodiment depicted here, the decrease in the reflector's 94 thickness may easily reach a factor of 5. Consequently, the cost of the reflector 94 will be heavily reduced. Furthermore, reducing the thickness of the reflector 94 will now make it possible to obtain shapes that otherwise would have been mechanically difficult and/or costly to obtain. For example, a round shape of the radiating part of the reflector 94, meaning the part of the reflector located facing the radiating element 91 serving as a trap, may directly be integrated into the design of the reflector 94 without any particular constraints. The round shape of the reflector 94 in the absence of any sharp angles near the power current areas, make it possible to stabilize the antenna's performance within the frequency band, by limiting the reflections and thereby reducing the ratio between the level of the electromagnetic wave towards the rear of the antenna and the level of that radiated towards the front of the antenna. As the reflector 94 is of much lesser thickness, all sorts of bends are now much easier to carry out, and the trapping function may thereby be directly integrated into the reflector 94. The feed array of the radiating elements 91 is held in place by hooks 100 placed on the back of the assembly device. All components 91, 94, 97, 98 assembled by the assembly device 96 are finally inserted into the radome 98.

It is understood from the preceding description that the inventive device has many advantages. Reducing the thickness makes it possible to expand the choice of materials for the reflector to low-cost materials such as metallized plastic, or metals of very low thickness. This leads to a significant decrease in cost. Direct metal-metal contacts are avoided to the greatest extent possible. The assembly may be dismantled without any damage. The dielectric member enables the components (radiating elements, reflector, etc.) that are connected to it to withstand greater vibrations and mechanical shocks. By its design, the assembly device makes it possible to overcome intermodulation products (IMPs).

The invention claimed is:

1. A panel antenna, comprising:

a three-dimensional cross- and dual-polarization radiating element comprising a support topped by a radiating plane, the support including at least two tubular portions;

a mechanical structure; and a dielectric member comprising:

a central area comprising a first fastening mechanism configured to secure the radiating element to the dielectric member, the first fastening mechanism including at least one protrusion configured to fit into an opening of a corresponding tube of the two tubular portions of the support of the radiating element;

two lateral areas at opposing ends of the dielectric member, each lateral area comprising a second fastening mechanism configured to secure a longitudinal edge of the mechanical structure to the dielectric member; and an intermediate area configured to provide a flexible linking between the central area and each lateral area;

wherein the second fastening mechanisms are hook-shaped and configured to hook onto the longitudinal edges of the mechanical structure.

2. The panel antenna according to claim 1, wherein the first fastening mechanism includes a snap-in-place fastening mechanism.

3. The panel antenna according to claim 1, wherein the dielectric member further comprises at least one dampener.

4. The panel antenna according to claim 1, wherein the dielectric member is made of a polymer material.

5. The panel antenna according to claim 4, wherein the dielectric member is molded as a single piece.

6. The panel antenna according to claim 1, wherein the dielectric member is disposed transversely compared to a longitudinal axis of the panel antenna.

7. The panel antenna according to claim 1, wherein the mechanical structure includes a radome and the second fastening mechanism is configured to cooperate with the radome.

8. The panel antenna according to claim 1, wherein the mechanical structure includes a reflector and the second fastening mechanism is configured to cooperate with the reflector.

9. An assembly device, comprising:

a dielectric member configured to facilitate assembly of a panel antenna having a three-dimensional cross- and dual-polarization radiating element and a mechanical structure, the radiating element including a support formed by a plurality of tubular portions, at least one first tubular portion for feeding the radiating element and at least one second tubular portion being open, the support being topped by a radiating plane, the dielectric member comprising:

a central area comprising a first fastening mechanism configured to secure the radiating element to the dielectric member, the first fastening mechanism including at least one protrusion configured to fit into an opening of a corresponding second tubular tube portion of the support;

two lateral areas at opposing ends of the dielectric member, each lateral area comprising a second fastening mechanism configured to secure a longitudinal edge of the mechanical structure to the dielectric member; and an intermediate area configured to provide a flexible linking between the central area and each lateral area.

10. The assembly device according to claim 9, wherein the at least one protrusion is configured to permit the radiating element to be snapped into place on the dielectric member.

11. The assembly device according to claim 9, wherein the second fastening mechanisms are hook-shaped and configured to hook onto the longitudinal edges of the mechanical structure.

12. The assembly device according to claim 9, wherein each lateral area of the dielectric member includes a dampener.

13. The assembly device according to claim 9, wherein the dielectric member is molded from a polymer or copolymer material.

14. The assembly device according to claim 13, wherein the dielectric member is a single piece.

15. The assembly device according to claim 9, wherein the dielectric member is configured to be disposed in transverse relation to a longitudinal axis of the panel antenna.

16. The assembly device according to claim 9, wherein the mechanical structure includes a radome and each second fastening mechanism is configured cooperate with a longitudinal edge of the radome.

17. The assembly device according to claim 9, wherein the mechanical structure includes a reflector and each second fastening mechanism is configured to cooperate with a longitudinal edge of the reflector.

18. A method of assembling a panel antenna, comprising:

snapping a three-dimensional cross- and dual-polarization radiating element for a panel antenna on a dielectric member, the radiating element including a support formed by a plurality of tubular portions, at least one first tubular portion for feeding the radiating element and at least one second tubular portion being open, the support being topped by a radiating plane, the dielectric member including a central area, two lateral areas at opposing ends of the dielectric member, and an intermediate area configured to provide a flexible linking between the central area and each lateral area, the central area of the dielectric member including a first fastening mechanism configured to secure the radiating element to the dielectric member, the first fastening mechanism including at least one protrusion configured to fit into an opening of a corresponding second tubular tube portion of the support; and hooking longitudinal edges of a mechanical structure for the panel antenna to the lateral areas of the dielectric member, each lateral area including a second fastening mechanism configured to secure the corresponding longitudinal edge of the mechanical structure to the dielectric member.

19. The method according to claim 18, wherein the mechanical structure includes at least one of a radome and a reflector and each second fastening mechanism is configured cooperate with a corresponding longitudinal edge of the radome or reflector.

* * * * *